United States Patent [19]

Sastri et al.

[11] 4,122,602

[45] Oct. 31, 1978

[54] PROCESSES FOR TREATING CUTTING EDGES

[75] Inventors: Suri A. Sastri, Stow; Steve S. Hahn, Wellesley, both of Mass.

[73] Assignee: The Gillette Company, Boston, Mass.

[21] Appl. No.: 803,290

[22] Filed: Jun. 3, 1977

[51] Int. Cl.[2] ..... B26B 21/54

[52] U.S. Cl. ..... 30/346.5; 30/346.53; 51/59 SS; 51/285; 76/104 R

[58] Field of Search ..... 51/59 R, 59 SS, 7, DIG. 2, 51/285; 30/346.53, 346.5; 76/104 R

[56] References Cited

U.S. PATENT DOCUMENTS

| | | | |
|---|---|---|---|
| 2,138,520 | 11/1938 | Elliot | 51/2 R |
| 2,460,919 | 2/1949 | Bodine | 51/59 R |
| 2,616,820 | 11/1952 | Bourgeaux | 148/6.15 R |
| 2,735,231 | 2/1956 | Simjian | 51/7 |
| 2,760,501 | 8/1956 | Gander | 134/58 |
| 2,858,652 | 11/1958 | Luthman | 51/267 |
| 2,994,165 | 8/1961 | Brevik | 51/164 |
| 3,423,880 | 1/1969 | Hershler | 51/7 |
| 3,698,408 | 10/1972 | Jacke | 134/122 |

*Primary Examiner*—Harold D. Whitehead

*Attorney, Agent, or Firm*—Richard A. Wise; William M. Anderson

[57] ABSTRACT

The present invention is concerned with processes for microhoning cutting edges and especially those of razor blades, wherein the edges are subjected to sonic energy and especially ultrasonic energy while said edges are in contact with a slurry or dispersion of abrasive particles which have diameters of less than 3 microns.

20 Claims, 2 Drawing Figures

PROCESSES FOR TREATING CUTTING EDGES

Generally razor blades are made by running thin strips of material, usually of steel, through a series of grinding operations and thereafter subjecting the resulting edges to honing and/or stropping procedures. In other methods the edges may also be formed, e.g. by chemical etching, electrolytic metal removal, swaging, peening, etc., followed by honing and/or stropping. Although the resulting edges when viewed with the naked eye appear to be smooth and uniform, they are not as smooth and uniform when viewed under a microscope, e.g., 800 magnification. In some instances the irregularities in the edges may be responsible for the nicks and cuts which are sometimes encountered in shaving. Further in order to get a quality shave, it is generally necessary that the tip radius of the ultimate edge (i.e., the estimated radius of the largest circle which may be positioned within the ultimate tip of the edge when such ultimate tip is viewed under a scanning electron microscope at magnifications of at least 10,000) be less than about 500 angstroms. Although blades with such tip radii generally provide quality shaves the ultimate edges are not as strong as they might be and their use-lives are often less than desired.

One object of the present invention is to provide novel micro-honing processes which will produce cutting edges and especially razor blades with stronger, smoother and more uniform edges.

Another object of the present invention is to provide novel microhoning processes which produce cutting edges and especially razor blades which, due to their improved geometry, provide better overall shaves, e.g., less nicks and cuts and have longer use-lives than razor blades which are not subjected to the microhoning processes of the instant invention.

Figure 1:
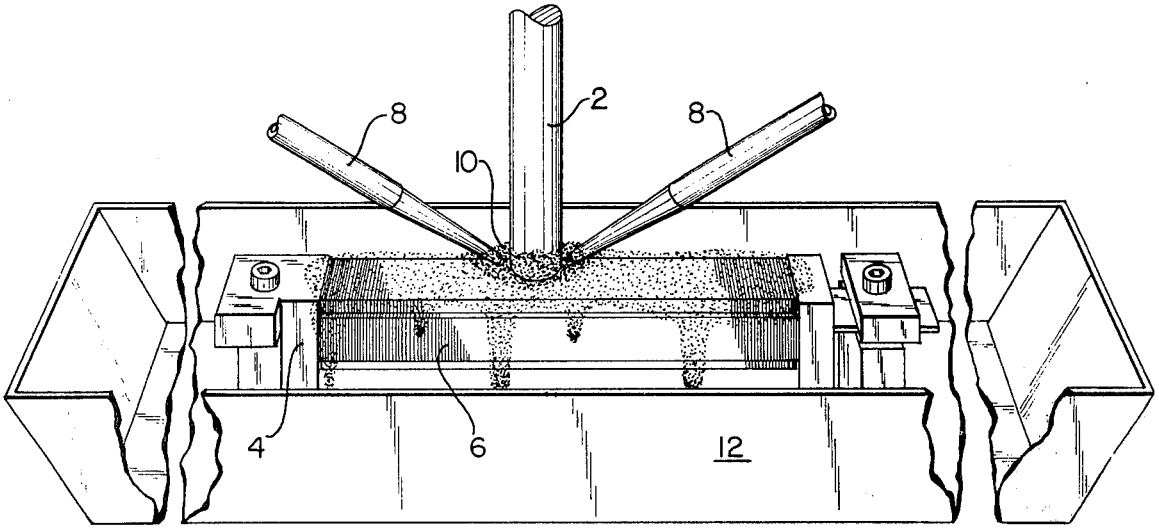
Figure 2:
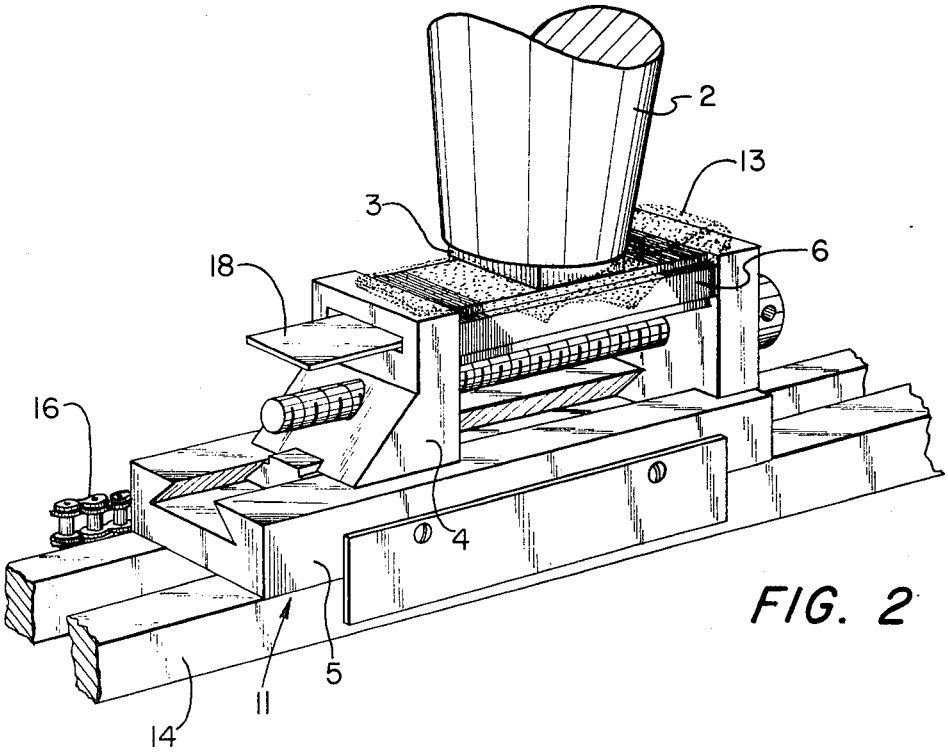

Other objects of the invention should be clear from the following description taken together with the claims along with the drawings, wherein FIG. 1 is a perspective view of an apparatus for carrying out one embodiment of the processes of the present invention; and FIG. 2 is a perspective view of another apparatus for carrying out a further embodiment of the processes of the present invention.

Generally the above objects are achieved by treating cutting edges and especially razor blade cutting edges with microhoning processes in which said edges are subjected to sonic energy and especially ultrasonic energy in the presence of a slurry or dispersion of abrasive particles which have diameters of less than 3 microns.

It has been found that as a consequence of the processes of the present invention the edges are substantially smoother and substantially more uniform. Such improved smoothness and uniformity generally results in improving the overall quality of the shaves, e.g., less nicks and cuts. It has also been found that through such processes the tip radii are substantially increased thus making the edges stronger and providing a substantial increase in the number of quality shaves which may be obtained.

Generally, the ultrasonic microhoning processes of the present invention may be carried out when the cutting edges are in various stages of formation or in various forms. Thus, for example, they may be performed on the sharpened edges after they have been initially formed, i.e. either after the grinding, chemical etching, electrolytic metal removal, peening, swaging, etc. steps, or after the edges have been formed by such steps and further subjected to stropping and/or honing steps. Further they may be carried out after the edges have been initially formed as set forth above and coated with protective and/or strengthening coatings, such as aluminum oxide, chromium, chromium nitride, chromium carbide, intermallic compounds such as chromium-platinum and other metals and alloys by processes such as the sputtering processes disclosed in U.S. Pat. Nos. 3,682,785 and 3,829,969. Still further, for example, the microhoning processes may be carried out after the initially formd edges have been sputter sharpened and coated by processes such as disclosed in U.S. Pat. No. 3,835,537.

If desired the microhoning processes disclosed herein may be used one or more times during the processes which are used to form the cutting edges.

In one of the more preferred embodiments of the present invention the edges as initially formed are microhoned and then subjected to sputter sharpening using ion bombardment techniques such as disclosed in U.S. Pat. No. 3,835,537, which is incorporated herein and made a part of this disclosure. Generally such sputter sharpening processes will be carried out until the tip radii are reduced to below 1000 angstroms if they were above this after the microhoning processes and preferably to below 500 angstroms. It has been found that such sputter sharpening can still further improve the quality of the shaves and further increase the edge strength. In especially preferred aspects of this embodiment the cutting edges subsequent to the sputter sharpening step are coated with a protective and/or strengthening coating using processes such as, for example, the sputter coating techniques set forth in U.S. Pat. Nos. 3,682,795 and 3,829,969. Although the thickness of the coatings may vary, generally they will lie between about 100 to about 600 angstroms. When desired after the final coating step the edges may again be microhoned.

In still another preferred embodiment of the present invention the cutting edges after being initially formed are microhoned and coated by a protective and/or strengthening coatings by methods such as disclosed in the heretofore mentioned patents. As in the processes set forth above the coated blades may be further microhoned if desired.

As is customary the finished cutting edges will usually be further coated with shave enhancing polymers such as polytetrafluoroethylenes, silicones, polyethylenes, etc. If desired the microhoning processes of this invention may be used on such shave enhancing coatings for example in order to reduce their thickness.

In the past sonic and especially ultrasonic energy has been used in machining processes, wherein a fluid comprising an abrasive is applied to the area to be machined while such area is concurrently subjected to high intensity sonic or ultrasonic energy. Generally in carrying out such machining processes it is the practice to use abrasives of the largest possible particle size which would fall below the amplitude of the ultrasonic transducer being used. Generally the abrasives employed have average diameters lying between about 10 to 100 microns. Although such ultrasonic machining processes have been used for making molds and other intricate objects it has not been proposed or thought they would be useful for honing razor blades edges. If fact, if anything, it might have been expected that such processes would blunt and destroy the edges, which, as pointed out above, generally have tip radii of less than 500 angstroms and are extremely fragile. Contrary to such expectations it has been unexpectedly found, as pointed out above, that by using such processes and employing abrasives which have diameters of less than 3 microns, smoother and more uniform edges are produced which result in improved shaves and that substantial increases in the tip radii can be brought about which strengthen the edges and result in substantially more quality shaves. Further unlike the regular uses to which ultrasonic machining has been used wherein the work object generally remains stationary, it is believed that the edges in the processss of the present invention vibrate and unexpectedly enhance the working thereon.

Generally the microhoning processes of the present invention may be carried out on the razor blades when they are in strip form as they leave the sharpening and honing and/or stropping machines, or when they have been separated into individual blades and stacked in blade magazines with their edges parallel to one another and their flat surfaces in face-to-face relationship. In most instances the former method is the least efficient in that a series of sonic or ultrasonic transducers have to be employed or the strip has to be snaked back and forth under one or more transducers in order that the edge may be subjected to the energy for the desired amount of time. When the latter method is employed (i.e., the blades are stacked in a magazine) a single sonic or ultrasonic transducer having a horn as wide as the edge may be employed and the blades may be microhoned in a single pass under the transducer. In other embodiments of the latter method, when the horn is not as wide as the blade edge, the blade magazine or the horn can be moved laterally back and forth as the two elements pass one another.

In one embodiment of carrying out the processes of the present invention the abrasive particles are present in a fluid slurry and are poured over the blade edges as they pass the horn or tool of the sonic or ultrasonic transducer. Generally the fluid slurry will be supplied from a storage tank which is equipped with a stirring device which keeps the particles of abrasive in suspension prior to application to the blade edges. When desired, for economic reasons, the fluid suspension subsequent to use may be collected and returned to the storage tank for reuse. Such fluid suspensions may be employed when the processes of this invention are carried out on the blades when they are in strip form or when they are stacked in magazines. Usually the rate of application of the fluid slurry to the edges during the processes will vary but generally it will be such that the edges will be bathed in it throughout the time they are under the influence of the ultrasonic energy.

In still another embodiment of the present invention a gelling agent, and especially a thixotropic gelling agent, is added to the abrasive slurry. In using such gelled slurries of the abrasives, a film of such material is applied to the blade edges before they are subjected to the horn or tool of the ultrasonic transducer. Such gels may be used when the blades are microhoned in strip form or when they are microhoned while stacked in blade magazines. In the embodiments in which a thixotropic gel is employed the gel under the influence of the ultrasonic energy will be converted to a fluid state in which form it will be used in the microhoning processes. Generally the thickness of the gel which is applied will vary but usually it will be such that there will be abrasives present during the entire period in which the edges are under the influence of the ultrasonic energy.

In further embodiments of the present invention the microhoning processes may be carried out in tanks such as employed for jewelry cleaning and polishing. Usually when carrying out the microhoning processes in this manner, it is more efficient when the blades are stacked in blade magazines rather than in strip form. In embodiments of this type, the abrasive slurry is placed in the tank and the blade edges are immersed in the slurry with the edges directed towards the bottom wall of the tank which (wall) serves as the horn. As in the other embodiments of this invention, it is desirable that the blade edges be as close to the horn (in this embodiment the bottom wall) as possible without touching and be coupled through the slurry with such horn. Further in this embodiment, it is also generally desirable in order to obtain consistent results that spacers be placed between the blades in the magazines. Generally the spacers serve to allow better movement of the abrasive slurries around and about the blade edges. Generally the thickness of the spacers are not critical as long as they provide the additional space between the blades. Usually spacers having a thickness of about 1/16 of an inch have proved quite satisfactory. Such spacers may also be used in the other embodiments set forth above but they are not generally necessary and only serve to complicate the processes and make them less economical.

As pointed out above the slurries which are used in the processes of the present invention comprise abrasive particles suspended in a fluid medium or vehicle which may or may not contain a gelling agent. Although just about any liquid or solvent, e.g., tetrachloroethylene, trichloroethylene, alcohol, etc. may be used as the fluid medium, water is the most economical and may in certain instances contribute to the microhoning process. Also the abrasive may be selected from the various materials of this nature which are available. As examples of useful materials mention may be made of silicon carbide, aluminum oxide, and boron carbide. Aluminum oxide has been found to be particularly useful and especially gamma alumina.

In microhoning razor blades the abrasive particles should have diameters of less than 3 microns, preferably 1 micron or less and more preferably 0.3 microns or less. Generally there is no lower limit on the particle sizes except for what may be dictated by availability and/or cost. Especially good results were obtained using abrasives having diameters of 0.10 microns or less. The concentrations of the abrasives in the slurries may generally be varied. Usually slurries comprising 4 to 20% by weight abrasives will provide good results. Slurries comprising 6 to 10% by weight of abrasives have been found to be particularly useful.

As pointed out above, in one of the preferred embodiments of the present invention, a gelling agent and preferably a thixotrophic gelling agent is added to the abrasive slurry so that a thin coating of it may be applied to the blade edges before they are subjected to the ultrasonic energy. Generally gelling agents including thixotropic ones are well known to the art and the one employed will depend upon the nature of the fluid. As examples of useful thixotropic gelling agents mention may be made of Cab-O-Sil M-5, the trademark of Cabot Corporation, Boston, Massachusetts for an amorphous fumed silica suspending and thickening agent, or aluminum stearate.

It is contemplated that when desired a detergent may be added to the slurries to aid in removing residual sharpening oils which may be on the blade. Also when desired the slurries may contain dispersing agents to aid in keeping the abrasive particles suspended. It is further contemplated that when desired the slurries may contain a corrosion inhibitor such as sodium nitrite to protect against any corrosion which may occur when fluids such as water are used as the vehicle.

As examples of useful fluid and thixotropic slurries mention may be made of the following compositions:

EXAMPLE I

A fluid slurry was prepared by adding, with stirring, 50 gms. of about 0.06 micron gamma aluminum oxide abrasive to 1 liter of distilled water.

EXAMPLE II

A thixotropic abrasive slurry was prepared by first making a 12% by weight thixotropic paste or gel of Cal-O-Sil M-5 in distilled water and then stirring in 10% by weight of about 0.06 micron gamma aluminum oxide abrasive.

The sonic and ultrasonic generators for use in the processes of this invention may be selected from the various apparatuses of this nature available. Generally there is no clear line of demarcation between what would be classified as sonic and what would be classified as ultrasonic. Audibility to the human ear is usually the criteria which is used to distinguish the two and this of course will vary from person to person. As a rule, sounds above 18 to about 20 kilohertz are classified as ultrasonic and those below as sonic. The use of sonic generators is less desirable in the processes of this invention in that the sounds are generally unpleasant to the ear and the processes are less efficient. If such deficits can be tolerated or guarded against, e.g., through the use of ear plugs, sonic generators, e.g., having frequencies between about 10 to about 18 kilohertz, may be used to provide beneficial results. Preferably the processes of this invention will be carried out with ultrasonic generators which as pointed out above will generally have frequencies of at least about 18 kilohertz. Generally there is no upper limit on the frequencies which may be employed but in most instances there will only be slight, if any benefit, from employing generators which have frequencies much above 100 kilohertz.

The power of the generators may also be varied. Generally there is no lower limit in the power which can be employed but, as will be understood, the lower the power the longer the processes will have to be carried out. As to the upper limit it will generally be below that amount of power which will remove the abrasive slurries from the edges before they do any appreciable work thereon. As can be appreciated such upper limit will vary with factors such as the concentration and viscosity of the slurry, the vehicle, the frequency, the distance of the horn from the edges, etc. In most instances generators having power between about 300 watts to 2000 watts will provide good results.

In a preferred manner of carrying out the processes of the present invention, the flat surface of the working end of the horn of the sonic or ultrasonic generators is positioned so as to be parallel to the plane formed by the edges when the blades are stacked in a magazine with their flat surfaces in a face-to-face relationship. Generally the distance between the end of the horn and the blade edges may be varied depending upon factors such as the power and frequency of the generator, the viscosity and concentration of the slurries, etc. Generally best results are obtained when they are positioned as close to one another as possible without touching and are coupled through the abrasive slurry. It has been found that when using a 20 kilohertz, 1000 watts generator, good results will be obtained when the end of the horn is between 20 to 70 thousandths of an inch from the edges.

Generally the periods for which the microhoning processes of the present invention are carried out will also vary with factors such as the power of the generator, the frequency, the distance of the horn from the edges, the concentration of the abrasives in the slurries, etc. Usually the microhoning processes are carried out until there is a substantial increase in the tip radius, e.g., at least 100 angstroms and preferably until the tip radius lies between 500 to 2000 angstroms and more preferably between 500 to 1000 angstroms. If the edges are to be subjected to sputter sharpening subsequent to the microhoning processes the microhoning processes may be carried out until the tip radius lies between about 500 angstroms to about 1 micron.

In preferred embodiments when sputter sharpening is used after the microhoning processes it is generally carried out until the tip radius is reduced below 1000 angstroms and preferably below 500 angstroms. As stated previously, after sputter sharpening the edges are preferably coated, e.g., by sputtering with a protective and/or strengthening coating of thicknesses for example of 100 to 600 angstroms.

Referring to FIG. 1, there is shown a perspective view of an apparatus 1 which may be used to carry out one embodiment of the processes of the present invention. The apparatus comprises a horn 2 which is attached to a 300 watt, 20 kilohertz frequency ultrasonic generator (not shown). The horn 2 is positioned in a manner such that a magazine 4 comprising a plurality of razor blades 6 may be moved underneath it and reciprocated laterally as it passes. The movement and reciprocation of the magazine 4 is accomplished by employing reversible gears with variable speed controls and trip switches (not shown). On each side of the horn 2 there are provided spouts 8 which are connected by hoses and pumps (not shown) to a storage tank (not shown) containing a fluid slurry of abrasive such as set forth in Example I, above. The spouts 8 are positioned to direct streams of the abrasive slurry 10 into the space between the end of the horn 2 and the edges of the blade 6, which is about 45/1000ths of an inch. The apparatus 1 is positioned in a pan 12 which serves to collect the used abrasive slurry 10 and return it to the storage tank for reuse.

In using the apparatus 11 shown in FIG. 1, the ultrasonic generator is turned on along with the spouts 8 for delivering the abrasive slurry 10 and the magazine is passed under the horn 2. Using the 300 watt, 20 kilohertz frequency ultrasonic generator, the rate of movement of the magazine under the horn is such that each blade edge will be subjected to the ultrasonic energy for about 25 to 75 secs. The resulting tip radius will be about 500 to 2000 angstroms depending on the time the edge was subjected to the ultrasonic energy.

In FIG. 2 there is shown another apparatus 11 for carrying out a further embodiment of the present invention. The apparatus 11 comprises a horn 2 which on one end is attached to a 20 kilohertz frequency, 1000 watts ultrasonic generator (not shown) and on its other end to a block of metal 3 whose width is at least about equal to the length of the razor blades 6 which are held in a magazine 4. The magazine 4 is mounted on a sled 5 which is moved along a track 14 by a chain 16 which is driven by a motor (not shown). The alignment of the blades 6 in the magazine is promoted through the use of a knife 18 which is inserted in the slots of the blades (not shown).

In using the apparatus 11 shown in FIG. 2 a thin layer, e.g., 45/1000ths of an inch of a gel and preferably a thixotropic gel of the abrasive 13 is applied over the edges of the blade 6. The ultrasonic generator is turned on and the sled 5 is removed along the track 14 at a rate such that each blade edge will be subjected to the ultrasonic energy for periods of about 7 to 10 secs. Under the influence of the ultrasonic energy the thixotropic gel becomes a liquid suspension in which state it takes part in the microhoning process. The blades subsequent to the process will have tip radii of about 1500 angstroms.

When microhoning double edges blades, or if it is desired to increase the production rate on single edge blades, magazines may be employed which will expose edges on more than one side and the apparatuses shown in FIGS. 1 and 2 may be modified so that a horn 2 or horns 2 can be positioned on each side where they are exposed edges. In one such embodiment (not shown) horns 2 are positioned on each side of the track 14 and the magazine 4 are adapted so that blade edges will be aligned vertically and exposed on each side of the track 16.

As pointed out above the processes of the present invention may also be carried out in ultrasonic cleaning baths such as are employed for cleaning and polishing jewelry. When employing this method the magazine is placed in the container in a manner such tat the blade edges will face and be within, e.g., ⅛ of an inch from the bottom of the container. Sufficient abrasive slurry or gel, such as set forth in Examples I and II, should be present in the container so that the edges of the blades will be immersed in it. Using a 150 watts, 20 kilohertz frequency generator and a 1 ½ gallon cleaning tank, the microhoning processes will generally be completed in 5 to 15 minutes per run of 200 blades.

When desired the working end of the horn may have various configurations other than being flat, e.g., it may be corrugated so that it is made up of a plurality of parallel elongated ridges and indents. In one such embodiment there are about 7 indents per inch and the indents are about 50 miles deep. Generally when using an apparatus such as shown in FIG. 2, and when the blade edges are arranged in the magazine so as to lie in a vertical plane and the end of the horn lies in a vertical plane, it has been found that the amount of microhoning is more uniform throughout the length of the edge of the blade if a corrugated horn is employed and the ridges of the horn are oriented so as to be parallel to the edges of the blades as they pass.

Still further improvements in the shaving quality of razor blades can be brought about by the processes of this invention if horns with corrugated ends are used in apparatuses such as shown in FIG. 2 and the ridges of said horns are arranged so as to be perpendicular to the length of the blade edges. It has been found that by using such an arrangement that the resulting blades are rated perceptively better as to reduced pull when they are tested in shaving panels against conventionally produced blades.

Subsequent to the processes of the present invention the blades are generally washed to remove any particles of abrasive which remain on them. The liquid which is used for washing will generally depend upon the fluid which was used in the abrasive slurry. Thus if water was employed the blades may be sprayed either using water pressure alone or by using water pressure in combination with sonic or ultrasonic energy. Subsequent to washing, the blades may be dried for example by subjecting them to a jet of warm air.

The following non-limiting examples illustrate processes within the scope of the present invention.

Example III

Sharpened blades intended for use in tandem type shaving units and having tip radii of about 250Å were placed in a magazine and covered with about 45/1000ths of an inch of an abrasive slurry similar to that set forth in Example II. The magazine was passed through an apparatus similar to that shown in FIG. 2 (using a flat ended horn) at a rate of 2000 blades per minute. After microhoning the edges had tip radii of 1200 angstroms. The resulting blades were then sputter sharpened for 2.5 minutes by techniques such as disclosed in U.S. Pat. No. 3,835,537 under the following conditions: a DC voltage of 1.67 K volts; a current of 30 micro amperes per blade and a pressure of 10 microns of argon. After the sputter sharpening step the blades had edge radii of approximately 100 angstroms and were then coated with about a 250Å thick film of $Cr_3$ Pt by methods such as disclosed in U.S. Pat. Nos. 3,682,795 and 3,829,969. Subsequent to the metallic coating step the edges of the blades were coated with polytetrafluoroethylene films by processes such as disclosed in U.S. Pat. No. 3,071,856. The resulting blades were placed in tandem razor cartridges and were shave tested in a 175 man test panel against non-microhoned blades. The results showed the microhoned blades were statistically significantly superior to the non-microhoned in overall shave quality. Further they gave fewer nicks and cuts during earlier shaves when such are most apt to occur. The microhoned blades were also consumer tested (72 man panel) against non-microhoned blades for two, two-week periods. The test results showed that the microhoned blades were significantly superior for overall closeness, caution, comfort, pull, nicks and cuts for each test period.

EXAMPLE IV

A magazine of production sharpened double edged blades were sputter sharpened and coated with about a 250 angstrom chromium film by method such as employed in Example III. The blades were coated with polytetrafluoroethylene films by methods similar to those disclosed in U.S. Pat. No. 3,071,856. The thus coated blades were then microhoned in an apparatus similar to that shown in FIG. 1, using a ¾ inch diameter flat-ended titanium horn and a gamma alumina slurry such as set forth in Example I. The microhoning was carried out until the edge radii increased from about 300 angstroms to about 1000 angstroms. The resulting blades were shave tested against non-microhoned blades in a 33 man test panel for ten shaves. The improved longevity of the microhoned blades was evidenced by the fact that they were significantly preferred over the control blades in overall shave quality during shaves 5 through 9 and superior for pull and closeness for shaves 5 and 7.

EXAMPLE V

A magazine of production sharpened double edge blades were sputter sharpened and coated in a manner similar to Example IV except that the microhoning step was carried out under conditions similar to those employed in Example III before the blades were coated with the polytetrafluoroethylene film. When the resulting blades were tested in a manner similar to that used in Example IV they again demonstrated their superiority as to providing an increased number of quality shaves.

EXAMPLE VI

A magazine of production sharpened blades were processed in a manner similar to that set forth in Example III except the end of the horn was corrugated and the ridges of the horn were oriented so that they were perpendicular to the edges. The resulting blades were shave tested in a 128 main panel for 14 shaves. The microhoned blades were rated significantly superior throughout the test for overall shave quality including reduced nicks and cuts. They are especially improved as to reduced pull.

EXAMPLE VII

A magazine of abrasively stropped, as sharpened blades when viewed at about 800X appeared smooth but showed "wire-like" protrusions when viewed with a scanning electron microscope at magnifications of greater than 10,000. When the blades were subjected to the microhoning processes of this invention and viewed under the scanning microscope the "wire-like" protrusions were absent and the edges were very smooth.

Having thus described the invention what is claimed is:

1. A process for microhoning the cutting edges of razor blades, said process comprising placing the edges in contact with a slurry of abrasive particles which have diameters of less than 3 microns and subjecting said slurry and said edges to sonic or ultrasonic energy from a horn or tool of a sonic or ultrasonic generator to cause said particles to hone said edges subjecting the edges to sonic or ultrasonic energy from the horn or too of a sonic or ultrasonic generator while said edges are in contact with a slurry of abrasive particles which have diameters of less than 3 microns.

2. A process as defined in claim 1, wherein said energy is ultrasonic.

3. A process as defined in claim 2, wherein said abrasive particles have diameters of 1 micron or less.

4. A process as defined in claim 2, wherein said abrasive particles have diameters of 0.3 microns or less.

5. A process as defined in claim 2, wherein said abrasive particles have diameters of 0.1 microns or less.

6. A process as defined in claim 2, wherein said microhoning process is carried out until there is an increase in the tip radius of the edge of at least 100 angstroms.

7. A process as defined in clam 2, wherein said microhoning process is carried out until the tip radius of the edge is at least 500 angstroms.

8. A process as defined in claim 2, wherein said microhoning process is carried out until the tip radius is between about 500 to 2000 angstroms.

9. A process as defined in claim 2, wherein said microhoning process is carried out until the tip radius is between about 500 to 1000 angstroms.

10. A process as defined in claim 2, wherein said edges subsequent to said microhoning process are subjected to sputter sharpening.

11. A process as defined in claim 10, wherein said sputter sharpening is carried out until said tip radius of the blade edges is below 1000 angstroms.

12. A process as defined in claim 10, wherein said sputter sharpening is carried out until the tip radius of the blade edges is below 500 angstroms.

13. A process as defined in claim 10, wherein subsequent to said sputter sharpening said edges are coated with a protective and/or strengthening coating.

14. A process as defined in claim 2, wherein said edges subsequent to said microhoning processes are coated with a protective and/or strengthening coating.

15. A process as defined in claim 2, wherein prior to said microhoning process said cutting edges are sputter sharpened and coated with a protective and/or strengthening coating.

16. A process as defined in claim 2, wherein said microhoning processes are carried out while said blades are stacked in a magazine with said cutting edges parallel to one another and with the flat surfaces of said blades being in face-to-face relationship and the end of said horn being a flat surface oriented to be parallel to the plane formed by said cutting edges.

17. A process as defined in claim 16, wherein a layer of a thixotropic gel of said slurry is spread over said edges before said edges are subjected to said ultrasonic energy.

18. A process as defined in claim 16, wherein said magazine during said microhoning process is oriented so that the cutting edges lie in about a vertical plane and the end of the horn providing the ultrasonic energy is corrugated and positioned so that the ridges of the corrugation are about parallel to the cutting edges.

19. A process as defined in claim 2, wherein said abrasives have average diameters of 1 micron or less, the microhoning process is carried out until there is an increase in the tip radius of the edge of at least 100 angstroms and subsequent to the microhoning process the edges are sputter sharpened and coated with a protective and/or strengthening coating.

20. A razor blade produced by the processes set forth in claim 1.

* * * * *

UNITED STATES PATENT AND TRADEMARK OFFICE

CERTIFICATE OF CORRECTION

PATENT NO. : 4,122,602

DATED : October 31, 1978

INVENTOR(S) : Suri A. Sastri

It is certified that error appears in the above-identified patent and that said Letters Patent are hereby corrected as shown below:

Column 2, line 66. "If" should be --In--

Column 3, line 13, "processss" should be --processes--

Column 7, line 19, "edges" should be --edged--

Column 7, line 34 "tat" should be --that--

Column 7, line 48 "miles" should be --mils--

Column 9, line 19, "main" should be --man--

Column 9, lines 43 to 47, after "said edges" delete "subjecting the edges to sonic or ultrasonic energy from the horn or too of a sonic or ultrasonic generator while said edges are in contact with a slurry of abrasive particles which have diameters of less than 3 microns"

Signed and Sealed this

*Third* Day of *April 1979*

[SEAL]

*Attest:*

RUTH C. MASON
*Attesting Officer*

DONALD W. BANNER
*Commissioner of Patents and Trademarks*